United States Patent [19]

Bernhardsson et al.

[11] 4,372,276

[45] Feb. 8, 1983

[54] ARRANGEMENT FOR SWITCHING A CARBURETOR IN INTERNAL COMBUSTION ENGINES

[75] Inventors: Ake A. Bernhardsson, Sollebrunn; Kent A. Svensson, Vänersborg, both of Sweden

[73] Assignee: Saab-Scania Aktiebolag, Sodertalje, Sweden

[21] Appl. No.: 159,282

[22] Filed: Jun. 13, 1980

[30] Foreign Application Priority Data

Jun. 19, 1979 [SE] Sweden ..... 7905386

[51] Int. Cl.[3] ..... F02M 13/08

[52] U.S. Cl. ..... 123/525; 123/575; 261/16; 261/44 C

[58] Field of Search ..... 123/525, 527, 575, 576, 123/577, 578, 439; 261/16, 44 C, DIG. 74

[56] References Cited

U.S. PATENT DOCUMENTS

| | | | |
|---|---|---|---|
| 2,381,304 | 8/1945 | Merrill | 123/527 |
| 3,855,974 | 12/1974 | Mayer | 123/439 |
| 3,974,813 | 8/1976 | Knapp et al. | 123/439 |

FOREIGN PATENT DOCUMENTS

| | | | |
|---|---|---|---|
| 2361359 | 6/1975 | Fed. Rep. of Germany | 261/16 |
| 594494 | 11/1947 | United Kingdom . | |
| 1218242 | 1/1971 | United Kingdom . | |
| 1253667 | 11/1971 | United Kingdom . | |

*Primary Examiner*—Charles J. Myhre
*Assistant Examiner*—Andrew M. Dolinar
*Attorney, Agent, or Firm*—Cushman, Darby & Cushman

[57] ABSTRACT

An arrangement for switching a carburetor in an internal combustion engine in a vehicle adapted for alternative operation on liquid or gaseous fuel. The carburetor is of the type where the pressure upstream of a throttle butterfly determines the engine air and fuel supply by the actuation of a piston provided with a metering needle. When using liquid fuel, the piston executes upward and downward movements, a passage leading through the carburetor thereby being constricted to a varying degree, and similarly the needle is caused to be thrust to a varying degree into a nozzle for metering liquid fuel to the engine induction air. This signifies too rapid wear of the metering needle in alternating operation on liquid and gaseous fuel. To prevent such wear, the invention provides an arrangement having at least one solenoid incorporated in an electrical circuit for at least indirectly actuating the piston to assume and retain a position minimally constricting the passage when gas is supplied to the engine induction system.

4 Claims, 3 Drawing Figures

ARRANGEMENT FOR SWITCHING A CARBURETOR IN INTERNAL COMBUSTION ENGINES

The present invention relates to an arrangement for switching a carburettor in an internal combustion engine in a vehicle adapted for alternative operation on liquid or gaseous fuel, e.g. petrol or so-called LP gas (LP=Liquefied Petroleum), said carburettor being formed with a through-passage constituting a part of the engine inlet duct in which there is disposed a manually actuable throttle valve, upstream of which there is an air valve formed with a piston for variably constricting the passage and provided with a tapered metering needle engaging in a nozzle and metering liquid fuel to the passage, as well as a nozzle for metering gaseous fuel through the passage, the supply of liquid or gaseous fuel through the respective nozzle being regulatable by means of solenoid valves controlled by an electrical circuit.

In carburettors of the kind mentioned, the metering needle has been found to wear considerably more rapidly in engines which alternatingly operate on liquid and gaseous fuel than in engines solely driven on liquid fuel, e.g. petrol. Fuel metering during petrol operation will rapidly become incorrect as a result of the needle wear, which unfavourably affects fuel consumption and gives rise to increase in exhaust gas emission.

The present invention has the object of providing a carburettor arrangement which in a simple and cheap way obviates the above-mentioned deficiency.

The invention is distinguished in that at least one solenoid incorporated in the electrical circuit is adapted to at least indirectly actuate the piston to assume and retain a position minimally constricting the passage, simultaneously as a first solenoid valve keeps the communication for the supply of gaseous fuel open and a second solenoid valve keeps the communication for the supply of liquid fuel closed. By means of the solenoid, the air valve can be caused to assume a position constricting said passage minimally and furthermore remain in this position as long as the engine is driven on gas. The needle is thus prevented from carrying out inward and outward movement relative to the nozzle when no petrol discharge takes place.

An advantageous embodiment of the invention is characterized in that the air valve piston is actuable by the solenoid for coming into engagement with a magnetizable iron core or the like. A simple solution is hereby obtained from the constructional point of view, the function of which does not affect and is not affected by the remaining systems of the engine.

Figure 1:
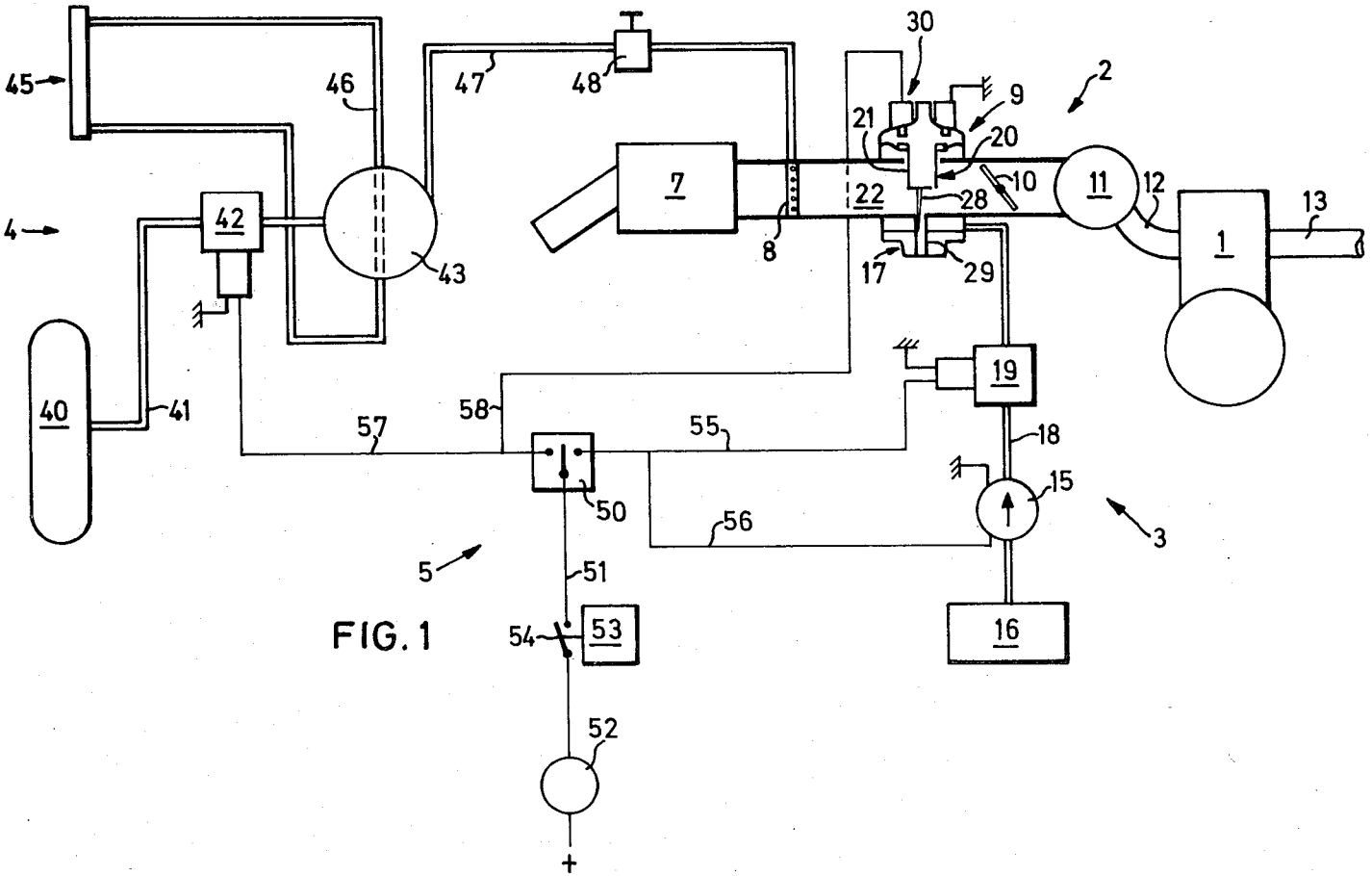
Figure 3:
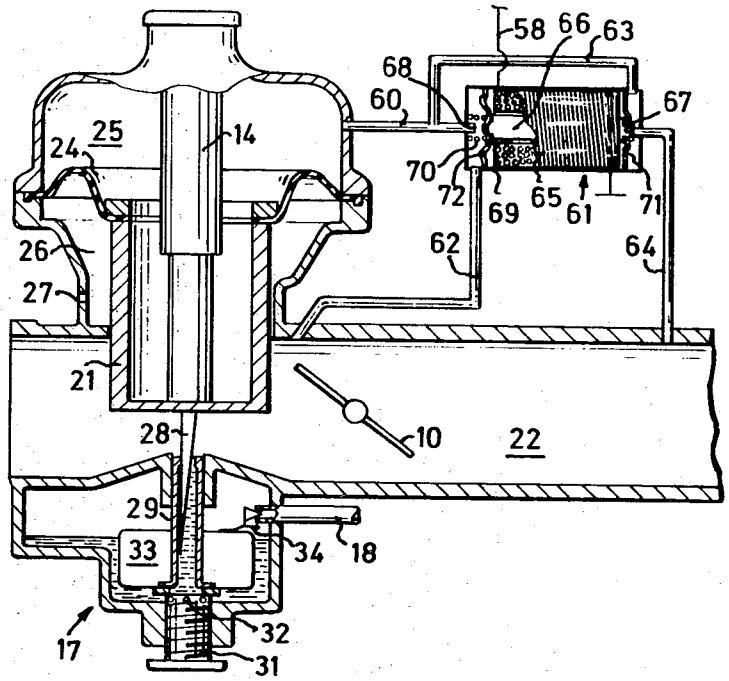
Figure 2:
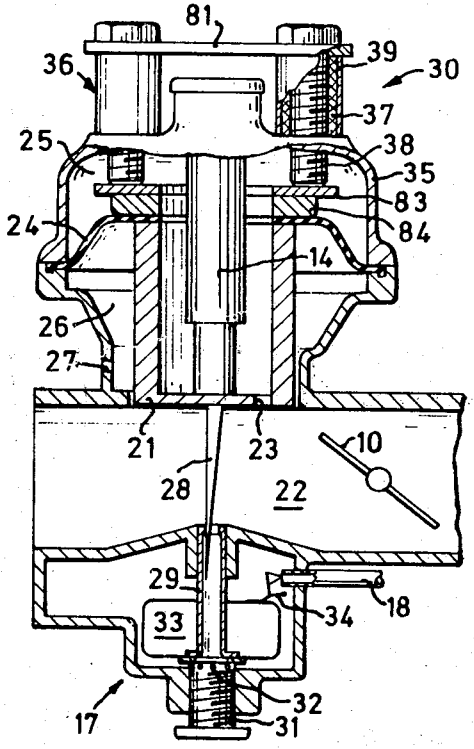

Other distinguishing features of the invention are apparent from the following description and patent claims. The description of an advantageous embodiment exemplifying the invention is done with reference to the attached drawings, in which:

FIG. 1 schematically illustrates an arrangement in accordance with the invention, FIG. 2 illustrates in a longitudinal section an advantageous embodiment of a carburettor, and FIG. 3 illustrates in the same way an alternative embodiment of such a carburettor.

The arrangement illustrated in FIG. 1 includes an engine 1 with an induction system 2 to which is connected a system 3 for the supply of petrol and also a system 4 for the supply of gaseous fuel. An electrical system 5 is arranged for controlling selection between said fuel systems.

Included in the induction system 2, seen in the direction of flow, there is an air cleaner 7, a nozzle 8 for the supply of gas, a carburettor 9 for the supply of petrol, a throttle butterfly 10, operable by the driver, for regulating the load on the engine, and an induction air collection chamber 11 from which a number of branch pipes 12 lead to the combustion chambers (not shown) of the engine. The exhaust gases are led from the combustion chambers via an exhaust gas system 13 which is only partially illustrated.

The carburettor 9 is fed with petrol via the system 3, which comprises an electric pump 15 for taking petrol from a tank 16 and via a pipe 18 urging the petrol further to a float chamber 17, constituting an integral part of the carburettor 9. A solenoid valve 19 is arranged for regulating the flow through the pipe 18.

The carburettor 9 is formed with a through-passage 22 constituting a part of the engine inlet duct. The carburettor 9 is in principle of the kind where the subpressure upstream of a throttle butterfly determines both air and fuel supply to the engine. The air supply is regulated by an air valve 20 which, in the form of a cylindrical piston 21, transversely encroaches in the passage 22 and variably throttles the through-flow. At its upper end the piston 21 is centrally attached to a diaphragm 24 which is peripherally clamped between two halves in a carburettor housing 35. In this mode the diaphragm 24 thus separates an upper chamber 25 from a lower chamber 26 in the carburettor housing 35. The piston 21 is hollow, and via a hole 23 in its bottom the air pressure in the inlet duct 22 can be caused to act on the upper side of the diaphragm 24. Atmospheric pressure acts in the chamber 26 since the chamber 26 communicates with its surroundings via an opening 27. The pressure varying in response to the engine load thus determines the position of the piston 21 and thereby the supply of air to the engine.

A damping means 14 disposed centrally in the piston 21 coacts telescopically with the piston 21. Since the means 14 is not part of the inventive subject and does not require explanation in order to understand the present invention, it will not be described further.

A tapered metering needle 28 is attached to the lower part of the piston 21. This needle is adapted for engaging in a nozzle 29 mounted in the float chamber 17. When the needle 28 accompanies the movements of the piston 21, it will be thrust to a varying amount into the nozzle 29. A petrol supply is thus obtained which is adjusted to the engine load prevailing at a given instant.

The nozzle 29 is supported from below by a set screw 31 adapted in the float chamber 17, said screw having a plurality of transverse holes 32 via which fuel is supplied to the nozzle 29. A float 33 surrounds the nozzle 29 and actuates a float valve 34 for regulating the supply of petrol to the float chamber 17 from the pipe 18.

The system 4 for supplying a gaseous fuel, e.g. LPG (Liquefied Petroleum Gas) or natural gas, includes a container 40 in which the gas assumes liquid form under pressure. The container 40 is connected to a vaporizer 43 via a solenoid valve 42 and a pipe 41. The valve 42 can be operated for opening or closing said pipe connection 41 by manual actuation of the electrical system 5. - Heat is supplied to the vaporizer 43 from the ordinary cooling system 45 of the engine via a pipe 46, and gas supplied in liquid form to the vaporizer 43 is successively transformed into gas. The gas flows via a pipe 47 and a quantity adjustment valve 48 through the annular gas nozzle 8 into the passage 22 leading to the engine 1. A fuel-air mixture intended for combustion in the engine occurs by mixture with passing inlet air.

By manual actuation of the electrical system 5 it is possible to control switching between gas and petrol operation. In consideration of this, there is a manually operable selector 50 which is supplied with current via a connection 51 connecting the selector 50 with the vehicle ignition switch 52. A contact 54, actuated by a relay 53, is also included in the connection 51. The contact 54 is operated by the relay 53 to close the connection 51 as soon as a start motor (not shown) for the engine 1 is activated. The contact 54 is then kept closed as long as the engine 1 is in operation. Said relay function 53 is not described further since it is already well-known and in practical use on vehicles for controlling electrically driven fuel pumps.

The selector 50 is connected via a connection 55 to the solenoid valve 19 for petrol supply. A connection 56 is in turn connected to the connection 55 for connecting the selector 50 to the electrically driven fuel pump 15. The selector 50 is furthermore connected by a connection 57 to the solenoid valve 42 which controls the gas supply. A connection 58 is also connected to the connection 57 for connecting the selector 50 to a magnetizable holder 30 on the carburettor 9. The holder 30 is intended to prevent movement of the metering needle 28 relative to the nozzle 29 when the engine 1 is supplied with gas. The holder 30 thus locks the air valve piston 21 and thereby the metering needle 28 in an upper position, whereby the passage 22 is substantially unobstructed.

With this function in mind, the magnetizable holder 30 comprises three solenoids 36 attached to the upper part of the carburettor housing 35. They are located in a circle concentric with the piston 21. The carburettor housing 35 as well as the piston 21 are made from non-magnetic light metal. Each of the solenoids 36 comprises a coil 37 surrounding a magnetizable bolt 38 functioning as an iron core. Each bolt 38 is fixed by threads to the carburettor housing 35, and thereby projects a given distance into the chamber 26 above the piston 21. Each coil 37 is surrounded by a protective sleeve 39, and an iron washer 81 engages commonly against the upper ends of the sleeves 39, said washer supportingly keeping the upper ends of the bolts 38 in position with each other when the bolts are tightened. A lower iron washer 83 is by means of a screw joint (not shown) attached to a clamping ring 84 which secures a diaphragm 24 to the piston 21.

When current passes through the coils 37, the bolts 38 are magnetized. The magnetic force thus caused acts on the iron washer 83 attached to the piston 21. If the distance between the bolts 38 and said iron washer 83 falls below a given value, which occurs when the engine is loaded to a given extent, said force is capable of lifting the piston 21 so that direct engagement occurs between the bolts 38 and the iron washer 83. The piston 21 is locked in this upper position as long as current flows through the coils 37 of the solenoids 36. The metering needle 28 is thus also locked in a corresponding upper position, which prevents wearing movements against the nozzle 29.

With the selector 50 set in a position corresponding to petrol operation, current is fed through the connections 55,56 to the solenoid valve 19 and the petrol pump 15. The valve 19 opens the petrol pipe 18 and the pump 15 starts feeding petrol to the carburettor 9. There is no current supply to the solenoid valve 42, however, and therefore no supply of gas takes place. Neither is there any current supply to the holder 30 on the carburettor, and this signifies that the air valve 20 operates quite unaffected by the holder 30.

With the selector set in a position corresponding to gas operation, current is fed to the solenoid valve 42, enabling gas to be fed to the engine inlet duct via the nozzle 8. Since the current supply to the fuel pump 15 is broken, the supply of petrol is interrupted in this case. Via the connection 58, current will be supplied to the solenoids 36 which, by the action of magnetic force on the piston 21, cause the latter to assume an upper position engaging against the holder 30 thereby leaving the passage 22 practically free for the passage of the fuel-air mixture.

In an alternative embodiment of the arrangement, in accordance with FIG. 3, the subpressure in the engine induction system 2 downstream of the throttle butterfly 10 is utilized to provide a so-called cut-out of the piston 21 in an upper position. In this case the chamber 25 above the piston 21 is in communication with the inlet passage 22 upstream of the butterfly 10 via an air duct 60, a solenoid valve 61 and an air duct 62. Here a hole communicating with the inlet passage 22 is not made in the bottom of the piston 21.

The chamber 25 is also in communication with the engine induction system 2 downstream of the butterfly 10 via the duct 60 with an interconnecting duct 63, the solenoid valve 61 and a duct 64. The solenoid valve 61 used in said duct communications is adapted such that when one duct communication is open, the other one is closed, and vice versa. In the illustrated example, the valve 61 is constructed with a coil 65 surrounding a core 66, the ends of which are adapted for coaction with valve seats 67,68 formed in the ends of the ducts 60 and 64 opening out into the valve 61. A spring 70 urges the core 66 to assume an initial position where the connection between the chamber 25 and the inlet passage 22 upstream of the butterfly 10 is open, whereas the connection between the chamber 25 and the induction system 2 downstream of the butterfly 10 is closed. The initial position is thus assumed when the coil 65 is not energized, while the opposite position is assumed when the coil 65 is energized. Sealing against the respective valve seat 67, 68 is ensured by a diaphragm 71,72 mounted at the end of the respective coil, each said diaphragm being peripherally clamped between different parts of the valve housing 69.

When petrol is to be supplied to the carburettor 9, current is not fed to the solenoid valve. The latter thus assumes the position illustrated in FIG. 3, air pressure upstream of the butterfly 10 being communicated to the chamber 25 via the duct 62, valve 61 and duct 60. In this state the air valve 20 functions in the same way as when the air pressure is communicated via a hole 23 in the bottom of the piston 21 according to FIG. 2.

When gas is to be supplied to the induction air of the engine, current is fed through the coil 65 thereby actuating the core 66 to assume a position closing the opening 68. The opening 67 is then opened, and the subpressure prevailing downstream of the butterfly 10 is transferred to the chamber 25 via the duct 64, valve 61 and ducts 63,60. Said subpressure lifts the piston 21 to its upper position and retains it there in said position until current supply to the coil 65 is interrupted. When this takes place, the solenoid valve 61 changes position and the pressure upstream of the butterfly 10 is once again communicated to the chamber 25.

The invention is not limited to the embodiments described above, but can be modified within the scope of the following patent claims to provide still further alternative embodiments.

What we claim is:

1. An arrangement for switching a carburettor for an internal combustion engine for alternative operation on liquid or gaseous fuel, said carburettor having a through-passage which forms a portion of an inlet duct to the engine, there being provided in said inlet duct a manually operable throttle valve and an air valve located upstream of said throttle valve, said air valve including a piston for variably constricting said through-passage and being provided with a tapered metering needle engaging in a first nozzle for metering liquid fuel to said through-passage, a second nozzle for metering gaseous fuel to said through-passage, the supply of liquid or gaseous fuel through the respective nozzles being regulatable by means of solenoid valves and an electrical circuit for controlling the solenoid valves, characterized in that at least one solenoid, incorporated in said electrical circuit, is adapted to at least indirectly actuate said piston to assume and retain a position minimally constricting said through-passage, simultaneously as one of said solenoid valves keeps the communication for the supply of gaseous fuel open and another one of said solenoid valves keeps a communication for the supply of liquid fuel closed, said arrangement including a chamber and being further characterized in that said solenoid is incorporated in a further solenoid valve which controls communication between said through-passage and said chamber for influencing the position of said piston in the air valve.

2. An arrangement as claimed in claim 1 including a duct opening in said through-passage downstream of said throttle valve and characterized in that said further solenoid valve is adapted to allow communication between said chamber and said through-passage via said duct when gaseous fuel is used.

3. In a fuel supply system for an internal combustion engine: a carburettor assembly for alternative operation on liquid or gaseous fuel, said carburettor assembly having a passage for passing fuel and air into the engine; an operator-controlled throttle valve in said passage; an air valve located upstream of the throttle valve, said air valve including a piston for variably constricting said passage, said piston being provided with a tapered metering needle engaging in a first nozzle for metering liquid fuel to said passage; a second nozzle for metering gaseous fuel to said passage; first and second valves for controlling the supply of liquid fuel and gaseous fuel to said first and second nozzles, respectively; means for opening and closing said first valve while closing and opening said second valve respectively; a pressure responsive means for influencing the position of said piston in said passage; a pressure transmitting means between said passage and said pressure responsive means; a third valve for controlling the pressure transmitted to said pressure responsive means through said pressure transmitting means; and means for opening and closing said third valve so that pressure is transmitted to said pressure responsive means for moving said piston to a position in which it minimally constricts said passage when said second valve is open and when said first valve is closed.

4. In a fuel supply system as claimed in claim 3, said pressure transmitting means comprising a pipe conduit between said passage downstream of said throttle valve and said pressure responsive means; and said third valve opening said pipe conduit when said second valve is open and said first valve is closed.

* * * * *